US006650071B2

(12) United States Patent
Elshof

(10) Patent No.: US 6,650,071 B2
(45) Date of Patent: Nov. 18, 2003

(54) COLOR DISPLAY TUBE WITH IMPROVED SHADOW MASK

(75) Inventor: Leonardus Antonius Maria Elshof, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/223,342

(22) Filed: Aug. 19, 2002

(65) Prior Publication Data

US 2003/0057891 A1 Mar. 27, 2003

(30) Foreign Application Priority Data

Aug. 23, 2001 (EP) ..... 01203169

(51) Int. Cl.[7] ..... H01J 29/07

(52) U.S. Cl. ..... 315/398; 313/470; 313/407; 313/471

(58) Field of Search ..... 315/377, 378, 315/398, 382, 399, 411; 313/402, 403, 407, 408, 462, 463, 470–474, 92

(56) References Cited

U.S. PATENT DOCUMENTS 3,705,322 A * 12/1972 Naruse et al. ..... 313/92
3,721,853 A 3/1973 Naruse et al. ..... 313/85 S
4,691,138 A 9/1987 Masterton ..... 313/403
4,794,299 A 12/1988 Chiodi et al. ..... 313/402
5,990,607 A * 11/1999 Tseng et al. ..... 313/407
6,166,486 A * 12/2000 Jee ..... 313/470

* cited by examiner

*Primary Examiner*—Wilson Lee
(74) *Attorney, Agent, or Firm*—Eric M. Bram

(57) ABSTRACT

In color display tubes (1) with a dotted shadow mask (13) structure and an in-line electron gun (10), the geometry of the screen (6) and the deflection field produced by the deflection unit (11) cause triad rotation, which is a rotation of the three phosphor dots (red, green and blue) corresponding to one aperture of the shadow mask (13) with respect to the horizontal scan lines (35). This problem can be solved by giving the horizontal lines (35) a curved shape. However, in the prior art situation a parabolic shape is used, leading to severe moiré problems, because the vertical pitch $a_{sv}$ (38) is influenced too strongly at the vertical screen edges. This problem can be overcome by using fourth order or even sixth order terms in the shape of the horizontal lines (35). A pure fourth order function reduces the vertical pitch $a_{sv}$ 38 variation by 50% with respect to the parabolic prior-art situation, and a pure sixth order function even leads to a reduction by 67%.

6 Claims, 6 Drawing Sheets

COLOR DISPLAY TUBE WITH IMPROVED SHADOW MASK

FIELD OF TECHNOLOGY

The invention relates to a color display tube comprising an electron gun, a display window with a screen, and a color selection electrode having a shadow mask positioned between the electron gun and the screen, said shadow mask, having a center point, a horizontal axis and a vertical axis intersecting at the center point, is provided with a hexagonal pattern of round apertures which are arranged on substantially horizontal and vertical lines.

The invention further relates to a shadow mask for use in such a color display tube.

BACKGROUND AND SUMMARY

A color display tube as described in the opening paragraph is generally known. Shadow masks with a pattern of more or less round apertures arranged in a hexagonal structure—also referred to as 'dotted type' shadow masks—are commonly used in cathode ray tubes for displaying data, like for instance computer monitors.

This kind of color display tube often shows a worsened landing performance, due to the geometrical construction of such a tube. The dots of one triad tend to be rotated on the screen. A triad is a set of three dots containing the three different colors of phosphor corresponding to one aperture in the shadow mask. Due to this phenomenon, which is referred to as triad rotation, the landing of the color display tube becomes more critical and consequently, the color purity performance is worse.

In principle this triad rotation problem, which is most significant in the corners of the display screen, can be solved by giving the horizontal lines a shape that follows the amount of triad rotation. As a result the horizontal lines should be barrel-shaped. This is disclosed in U.S. Pat. No. 3,721,853, resulting in a color display tube with an improved color purity.

However, the solution as described in U.S. Pat. No. 3,721,853 brings about another problem: due to the barrel-shaped horizontal lines, the distance between the horizontal lines—that is, the vertical pitch—varies quite largely over the entire screen leading to moiré problems.

It is an object of the invention to obviate this drawback by providing a color display tube with an improved shadow mask which properly solves the triad problem and also has an excellent moiré performance.

According to the present invention, this object is achieved by means of a color display tube which is characterized in that the apertures on a horizontal line follow a curved trajectory which is a polynomial of order 2n that can be described by $$y = y_0 \cdot \sum_{k=0}^{n} a_{2k} \cdot x^{2k}$$

in which x is the horizontal coordinate and y is the vertical coordinate measured with respect to the center point, $y_0$ is the intercept of the horizontal line (21) with the vertical axis, $a_0=1$ and $a_{2k}$ are constants for $1 \leqq k \leqq n$ at least one of which is unequal to zero.

The invention is based on the insight that by using a polynomial of order higher than two, it is possible to obtain in the corners the same amount of inclination of the horizontal lines but the positional difference will be smaller. This is in contrast to the prior art shadow masks having a pure parabolic shape of the horizontal lines. This is a direct consequence of the general nature of polynomial functions. As a result, the difference in vertical pitch between the center region and the edge region will be smaller. This measure enables a design of the shadow mask that fully compensates the triad rotation in the corners, in combination with a much smaller deviation of the vertical pitch, which is very beneficial to the moiré performance of the color display tube.

In practice, in most cases a satisfactory solution will be reached with a horizontal line shape that is characterized in that $y=y_0.(1+a_2.x^2+a_4.x^4+a_6.x^6)$ and at least $a_4$ or $a_6$ is unequal to zero.

The direction of the triad rotation is such that the vertical pitch at the vertical edges is smaller than on the vertical axis. This is achieved by making the horizontal lines barrel-shaped. This means that the first derivative of the formulae for the horizontal line should fulfil the condition $2.a_2+4.a_4.x_{max}^2+6.a_6.x_{max}^4 \leqq 0$, in which $x_{max}$ is the x-coordinate at the end of the horizontal axis.

In a preferred embodiment, $y=y_0.(1+a_4.x^4)$. A horizontal line the deviation of which is a pure fourth order term causes the deviation of the vertical pitch to be improved by a factor of two as compared to the parabolic term, while the inclination for opposing the triad rotation remains the same.

In a further embodiment, the improvement with respect to the deviation of the vertical pitch can be increased to a factor of three by using a pure sixth order term in the formulae for the horizontal line shape, that is to say, the horizontal line shape is given by:

$$y=y_0.(1+a_6.x^6).$$

The invention further relates to a shadow mask for use in such a color display tube.

These and other aspects of the invention are apparent from and will be elucidated by way of non-limitative examples with reference to the drawings and the embodiments described hereinafter.

BRIEF DESCRIPTION OF THE DRAWING FIGURES

IN THE DRAWINGS

DETAILED DESCRIPTION

Figure 1:
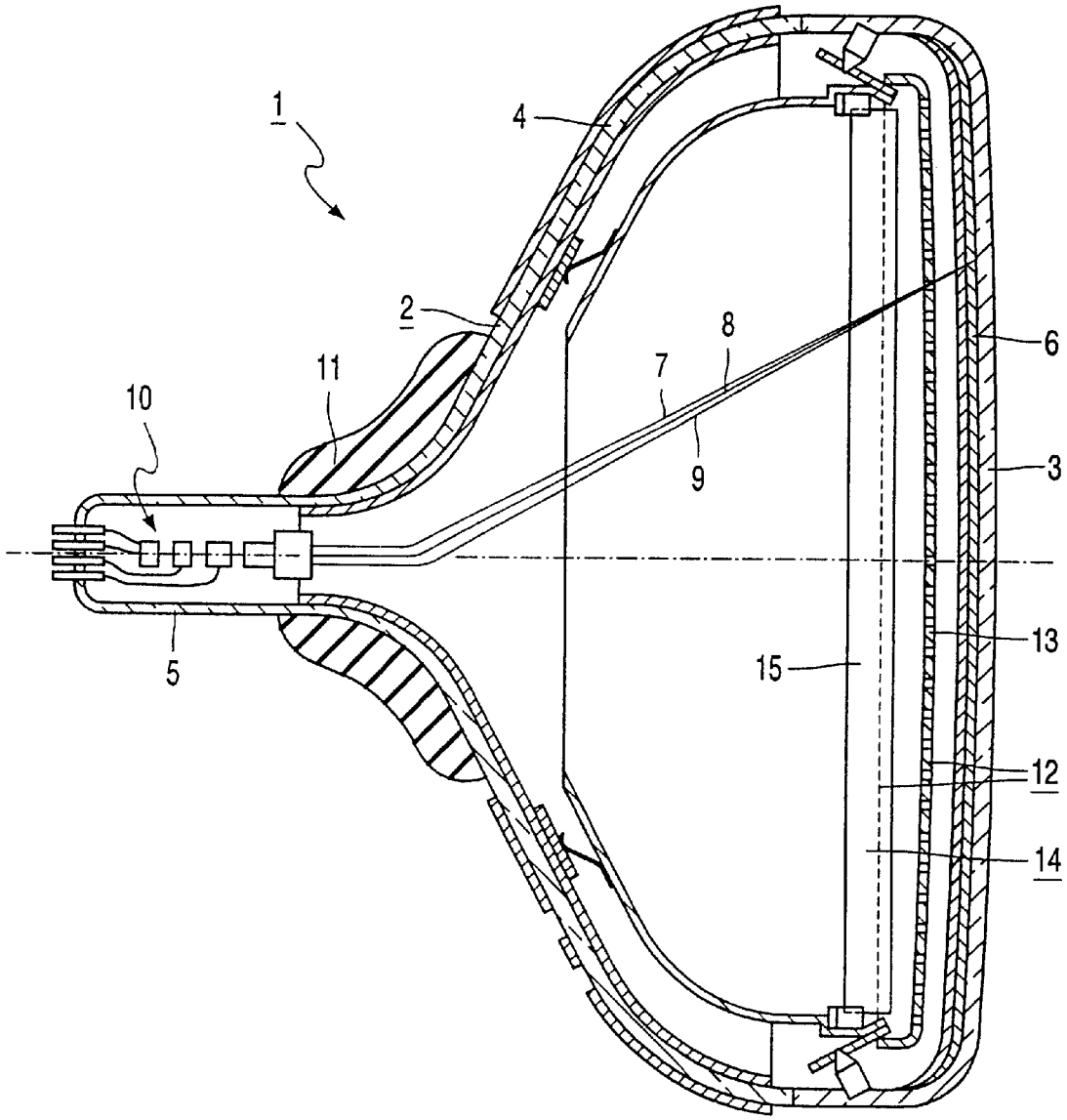
FIG. 1 is a sectional view of a color display tube according to the invention.

The color display tube 1 shown in FIG. 1 comprises an evacuated glass envelope 2 with a display window 3, a funnel shaped part 4 and a neck 5. On the inner side of the display window 3 a screen 6 having a pattern of dots of phosphors luminescing in different colors (e.g. red, green and blue) may be arranged. The phosphor pattern is excited by the three electron beams 7, 8 and 9 that are generated by the electron gun 10. On their way to the screen the electron beams 7, 8 and 9 are deflected by the deflection unit 11 ensuring that the electron beams 7, 8 and 9 systematically scan the screen 6.

Before the electrons hit the screen 6 they pass through a color selection electrode 12. This color selection electrode 12 comprises a shadow mask 13, which is the real color selective part: it intersects the electron beams so that the electrons only hit the phosphor of the appropriate color. The shadow mask 13 according to the present invention is provided with round apertures; round is to be taken to mean circular, elliptical, elongate or similar shapes. Furthermore, the color selection electrode 12 comprises the frame 14 for supporting the shadow mask 13, which frame is suspended from the display window 3.

Figure 2:
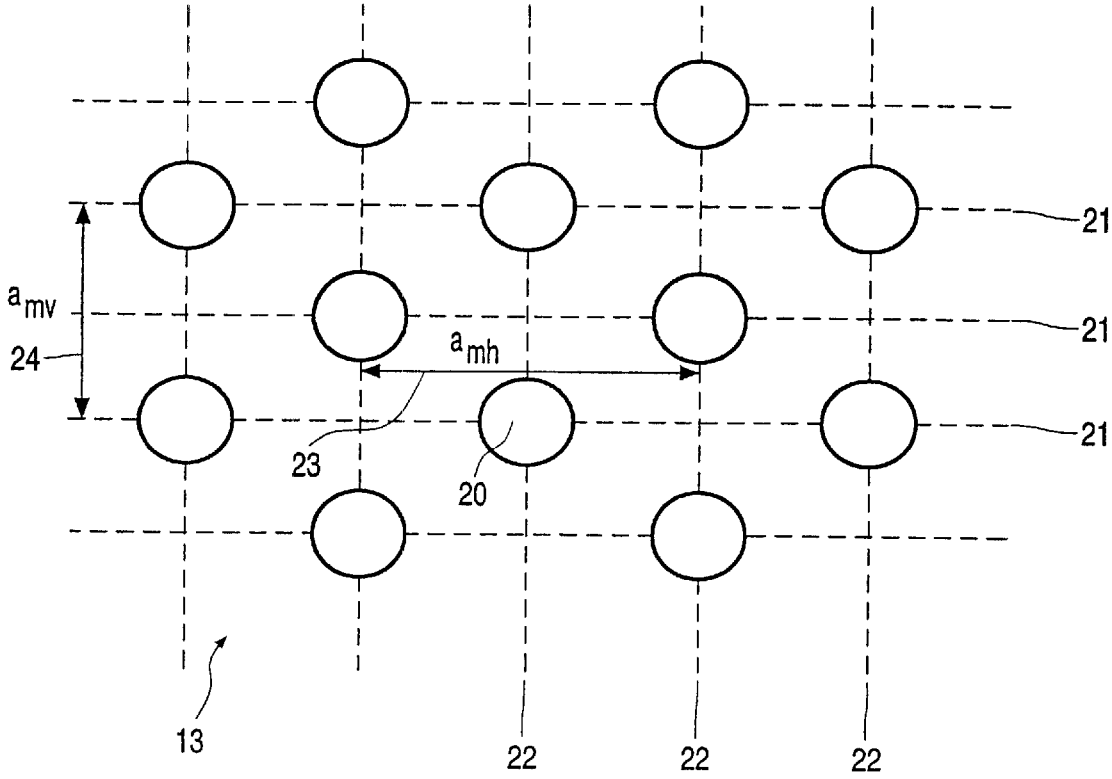
FIG. 2 is a section of a shadow mask with a dotted structure.

In color display tubes 1 with a dotted screen pattern, the shadow mask 13 is normally provided with a pattern of apertures 20 arranged in horizontal lines 21 and in vertical lines 22. FIG. 2 shows this commonly used shadow mask pattern. It is noted that, in order to obtain a hexagonal structure of the phosphor dots on the screen 6, the apertures of the shadow mask 13 occur alternately at the intersections of the horizontal and vertical lines. In color display tubes 1 with a dotted shadow mask 13 the horizontal mask pitch $a_{mh}$ 23 is defined as the distance between two adjacent apertures on the same horizontal line; analogously, the vertical mask pitch $a_{mv}$ 24 is defined as the distance between two adjacent apertures on the same vertical line.

Figure 4A:
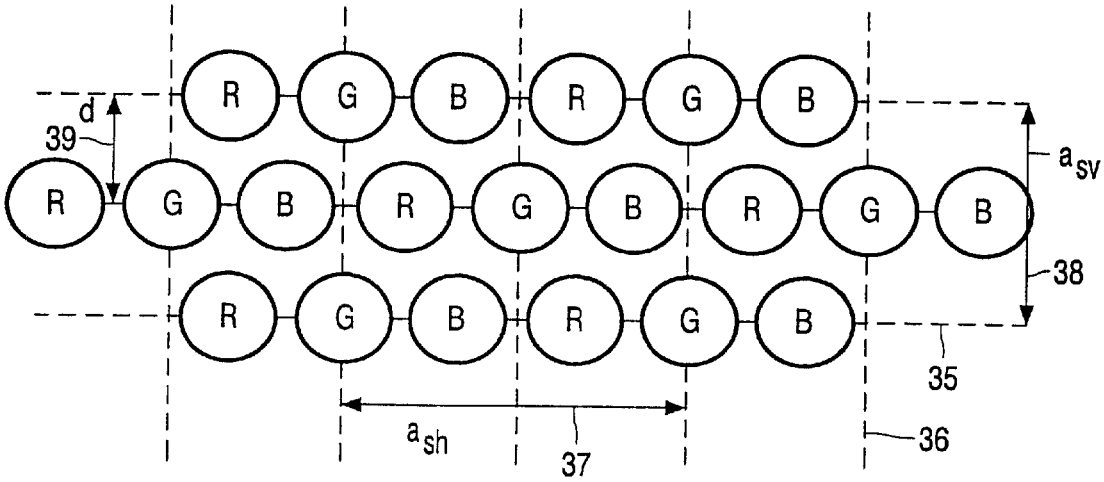
FIGS. 4A–4D show the arrangement of several triads on the screen indicating the consequences of triad rotation.

In most present color display tubes 1, the electron gun 10 generates three electron beams in the horizontal plane; this type of electron gun is referred to as an 'in-line' electron gun. As a result, each aperture 20 in the shadow mask corresponds to a triad of phosphor dots on the screen 6, which phosphor dots are arranged in the horizontal direction as well. Each triad comprises phosphor dots capable of emitting light in one of the primary colors, like for instance red, green and blue; as indicated in FIG. 4A by means of the letters R, G and B, respectively, in the dots. The triads are arranged on horizontal lines 35 and vertical lines 36, with the center dot of each triad being situated at an intersection.

Figure 3:
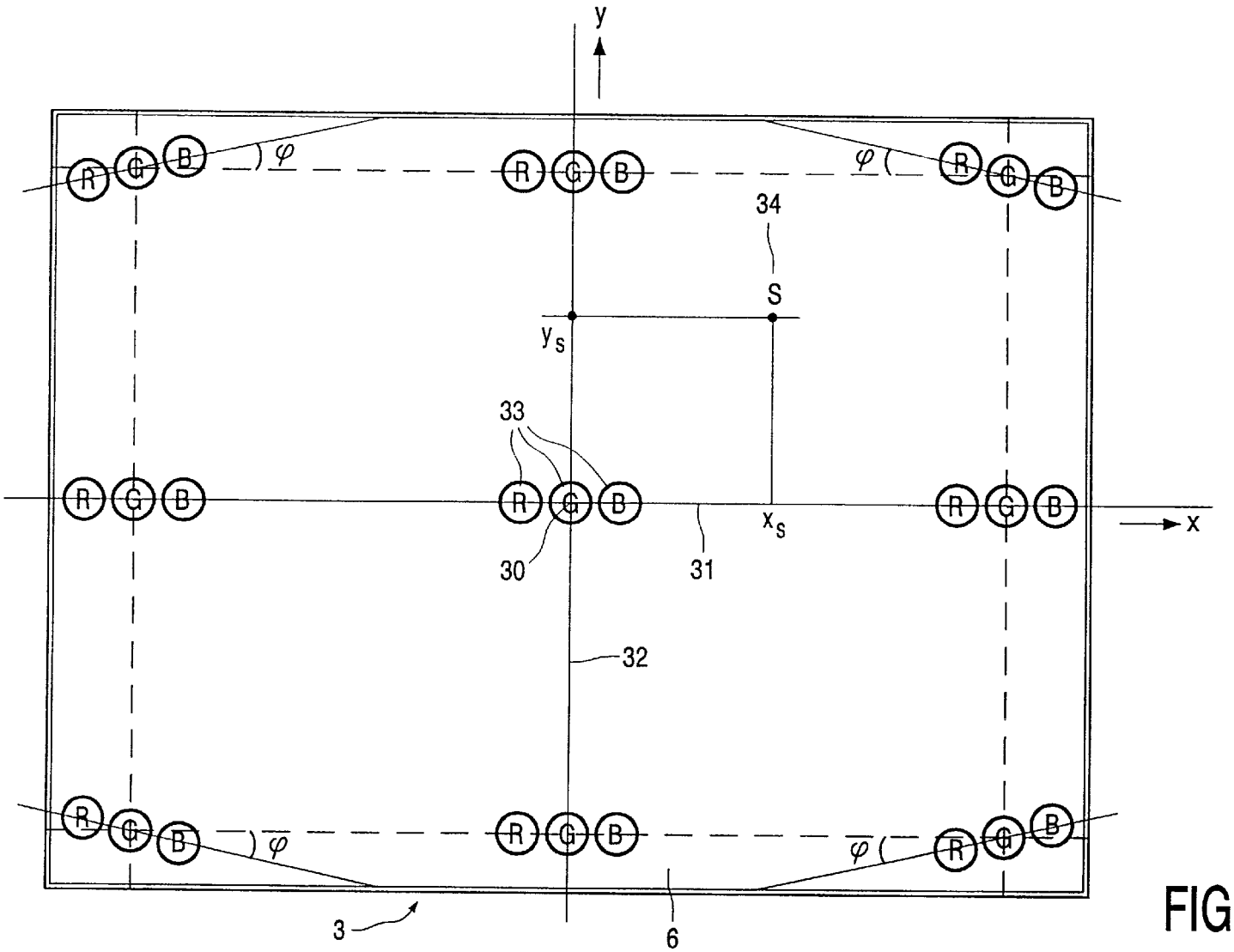
FIG. 3 is a schematic view of the display window, indicating the triad rotation at several locations for a shadow mask with straight horizontal lines.

FIG. 3 shows the arrangement of triads on the screen 6 of the display window 3 for a dotted shadow mask 13 in combination with an 'in-line' electron gun 10. For convenience, a coordinate system has been chosen with the origin 30 in the center of the display window 3, the horizontal axis is the x-axis 31 and the vertical axis is the y-axis 32; this choice of coordinate system should not be interpreted as limiting the scope of the present invention.

It is well known, see for instance U.S. Pat. No. 3,721,853, that in color display tubes 1 with a dotted type shadow mask 13 in which the apertures are arranged on straight horizontal lines, triad rotation occurs. Due to the deflection field, which, in operation, is generated by the deflection unit 11, and the fact that the shape of the screen 6 at the inner side of the display window 3 is often more or less spherically curved, the triads are rotated on the screen 6 and land in positions off the axes 31,32. This rotation is in general proportional to the product of the x and y coordinate of the corresponding screen position. If we use the point S given by the coordinates $x_s$ and $y_s$ to denote a certain screen position 34, then the amount of triad rotation, expressed as the angle $\phi$ through which the triad is rotated, is given by:

$$\phi = C_t . x_s . y_s$$

in which $C_t$ is a constant that depends on the deflection field and the geometry of the inner side of the display window 3. From this, it follows that the triad rotation is the largest in the corner sections of the color display tube 1, so that the color purity performance is most critical in these areas.

As will be shown with the aid of FIG. 4, triad rotation has an adverse effect on the landing performance in a color display tube 1. In order to display a picture with a good color purity on a color display tube 1, it is of the utmost importance that the electron beams 7, 8, 9 land on a phosphor of the proper color. A landing error may lead to a loss of luminance if the electrons do not impinge on the proper phosphor, or even to wrong colors if the electrons impinge on adjacent phosphors of a different color.

FIG. 4A gives the situation without triad rotation: all phosphor dots are about equally spaced. This gives the best landing performance, because the distance that an electron beam 7, 8, 9 may deviate from its nominal position is optimal in this situation. The horizontal pitch 37 and the vertical pitch 38 on the screen 6 are denoted by $a_{sh}$ and $a_{sv}$. Due to the projection of the electron beams 7, 8, 9 on the screen 6, the screen pitches 37, 38 are slightly larger than the corresponding mask pitches 23, 24.

Figure 4B:
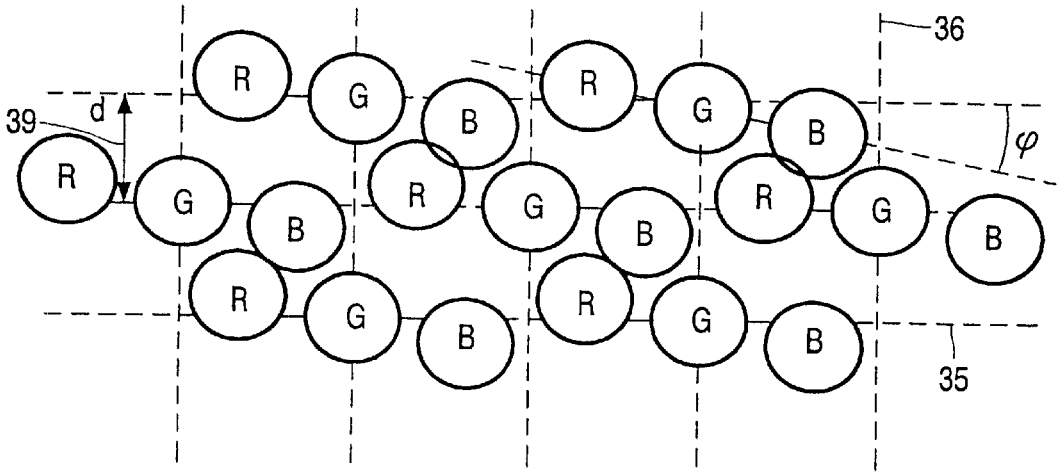
Figure 4C:
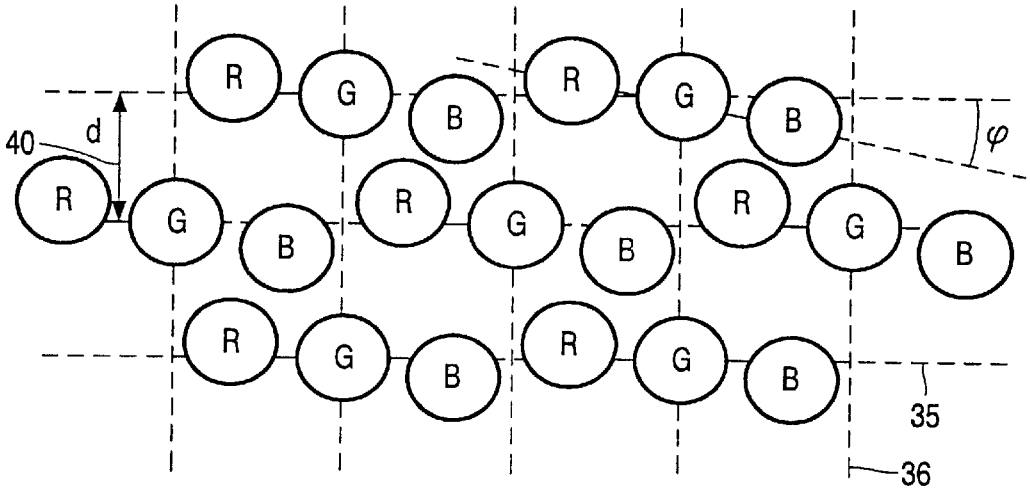
Figure 4D:
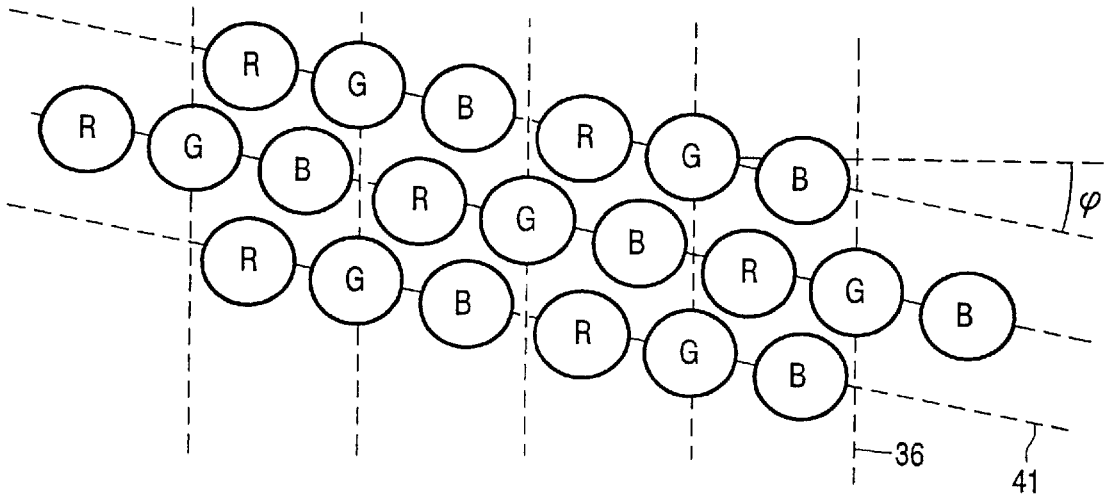

FIG. 4B shows the effect of a triad rotation through an angle $\phi$, as may be the case in for instance the corner area of the screen. In this example, it is clear that the landing performance is very poor: the red and blue phosphor dots overlap, making a good landing performance impossible. There are several ways to solve this problem. One way is to increase the distance d 39 between the horizontal lines 37 from, for instance from d 39 to d' 40 as shown in FIG. 4C. As a result the phosphor dots no longer overlap and a good landing performance can be obtained. However, this measure causes the number of triads per area to be reduced, leading to a decrease of the luminance level, especially in the corner areas. This causes the luminance distribution over the screen 6 to be less uniform, which is an unwanted aspect.

An alternative way of solving the problem is by making the horizontal lines 21 on which the apertures 20 in the shadow mask 13 are arranged curved, in such a way that on the screen 6 the curved lines extend in the direction of the triad rotation for each position on the screen 6. This situation is given in FIG. 4D, leading to a good landing performance, without a reduction in luminance.

In prior art color display tubes 1 this solution is implemented by giving the horizontal lines 35 the shape of a parabolic function. Due to this the distance d 39 between the horizontal lines 35 will become less when the x-coordinate increases from 0 to $x_{max}$. This is a serious disadvantage with respect to the moiré performance of the color display tube 1. For a given number of scan lines that are displayed, the ratio between the number of scan lines and the vertical pitch $\alpha_{sv}$ is the most important parameter determining the moiré behavior of the color display tube. Deviations from the ideally chosen ratio by only a few percent may lead to serious moiré problems.

According to the present invention these moiré problems are largely overcome by choosing a higher order polynomial shape for the horizontal lines 35. The idea is to shape the horizontal lines 35 in such a way that the inclination matches the amount of triad rotation at the edges—that is where the x-coordinate is about $x_{max}$—and to have slight deviations between the inclination of the horizontal lines and the angle of the triad rotation for the intermediate regions.

The present invention is illustrated with reference to FIG. 5 and will be discussed by way of the following, non-limitative example.

It is assumed that a color display tube 1 has the following properties: a screen measuring 320 mm in the horizontal direction and 240 mm in the vertical direction, that is: $x_{max}$=160 mm and $y_{max}$=120 mm.

Furthermore, the triad rotation, further denoted by $\phi$, in the corners is assumed to be 4 degrees.

In a color display tube 1 according to the prior art, the horizontal line shape is a second order function 50, which can be expressed by the formulae: $y=y_0.(1+a_2.x^2)$.

Now the condition that the triad rotation at the edge, where $x=x_{max}$, equals the inclination of the horizontal line 35 can mathematically be given by:

$$\tan(\varphi) = \frac{dy}{dx}(x_{\max}) = 2 \cdot y_0 \cdot x_{\max} \cdot a_2$$

from which $a_2$ can be determined:

$$a_2 = \frac{\tan(\varphi)}{2 \cdot y_0 \cdot x_{\max}}$$

Substituting the values for the horizontal line along the upper edge, where $y_0=y_{max}$ yields $a_2=-1.82.10^{-6}$ $mm^{-2}$, so that $y(x_{max})=114.4$ mm, which is 4.7% smaller than the value $y_0$ at the y-axis, in other words: when x increases from 0 to $x_{max}$, the vertical pitch $a_{sv}$ 38 diminishes by 4.7%, a figure that can lead to serious moiré problems.

According to the present invention, the horizontal line shape comprises a fourth or sixth order term. In the case of a pure fourth-order horizontal line shape 51 the following applies: $y=y_0.(1+a_4.x^4)$.

Furthermore, the condition that the triad rotation $\phi$ at the edges equals the inclination of the horizontal line 35 leads to the condition:

$$\tan(\varphi) = \frac{dy}{dx}(x_{\max}) = 4 \cdot y_0 \cdot x_{\max} \cdot a_4^3.$$

By substituting the values for the corner the following value is obtained $a_4=-3.55\ 10^{-11}$ $nm^{-4}$, so that $y(x_{max})=117.2$ mm. In this case the vertical pitch $a_{sv}$ at the edge diminishes by 2.3%, which is a reduction by fifty percent compared to the prior art situation. This horizontal line shape gives a much better moiré performance.

An even greater improvement can be obtained by using a pure sixth order polynomial 52 for the horizontal line shape 35 along the top edge.

Now the following formulae are valid:

$$y = y_0 \cdot (1 + a_6 \cdot x^6) \text{ and}$$

$$\tan(\varphi) = \frac{dy}{dx}(x_{\max}) = 6 \cdot y_0 \cdot x_{\max} \cdot a_6^5,$$

$$\text{yielding } a_6 = -9.25\ 10^{-16}\ \text{mm}^{-6} \text{ and } y(x_{\max}) = 118.1\ \text{mm},$$

which diminishes the vertical pitch $a_{sv}$ by only 1.6%, being one third of the prior art value.

These examples show that it is possible to improve the moiré performance in a color display tube 1 by designing the horizontal line shape so as to comprise higher order polynomial components. The difference in vertical pitch along the edges can be significantly diminished, while maintaining the condition that the inclination of the horizontal lines should be equal to the triad rotation along the edges.

Figure 5:
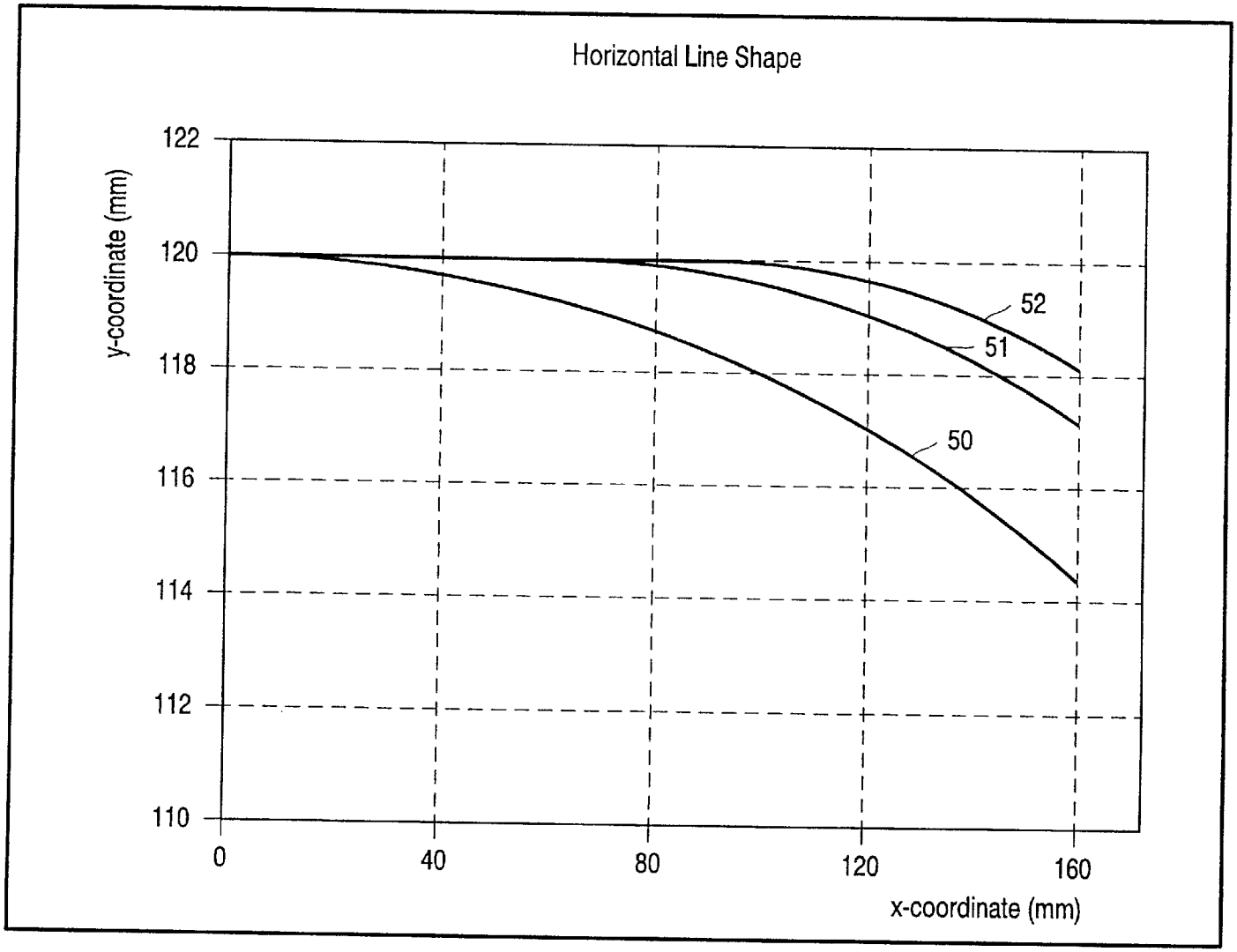
FIG. 5 is the horizontal line shape along the top edge.

From the shape of the horizontal lines in FIG. 5 it can be derived that for higher order polynomial coefficients the lines follow the straight horizontal line over a significantly larger trajectory, leading to an improvement in moiré performance. This phenomenon can be further exploited by making a line shape of even higher order. However, this has the disadvantage that it will show a much more sudden change in pitch along the vertical edges, leading to too large differences in pitch and in luminance locally along these edges.

Of course, other, possibly more complex functions may be used to describe the shape of the horizontal lines 35. For that reason, this invention is not limited to fourth and sixth order polynomial functions, but also includes functions which meet the same requirements, that is the inclination of this function at the vertical screen edge should substantially equal the amount of triad rotation at that location and at the same time the change in vertical pitch $a_{sv}$ should be limited in order to have a good moiré performance.

In summary, in color display tubes 1 with a dotted shadow mask 13 structure and an in-line electron gun 10, the geometry of the screen 6 and the deflection field produced by the deflection unit 11 cause triad rotation, which is a rotation of the three phosphor dots (red, green and blue) corresponding to one aperture of the shadow mask 13 with respect to the horizontal scan lines 35. This problem can be solved by giving the horizontal lines a curved shape. However, the prior art situation gives a parabolic shape, leading to severe moiré problems, because the vertical pitch $a_{sv}$ 38 is too strongly influenced at the vertical screen edges. This problem can be overcome by using fourth order or even sixth order terms in the shape of the horizontal lines 35. A pure fourth order function reduces the vertical pitch $a_{sv}$ 38 variation by 50% with respect to the parabolic prior-art situation, and a pure sixth order function causes a reduction by even 67%.

What is claimed is:

1. A color display tube (1) comprising an electron gun (10), a display window (3) with a screen (6), and a color selection electrode (12) having a shadow mask (13) positioned between the electron gun (10) and the screen (6), said shadow mask (13), having a center point, a horizontal axis and a vertical axis intersecting at the center point, is provided with a hexagonal pattern of round apertures (20) which are arranged on substantially horizontal (21) and vertical lines (22), characterized in that the apertures (20) on a horizontal line (21) follow a curved trajectory which is a polynomial of order 2n that satisfies equation:

$$y = y_0 \cdot \sum_{k=0}^{n} a_{2k} \cdot x^{2k}$$

in which x is a horizontal coordinate and y is a vertical coordinate measured with respect to the center point, $y_0$ is an intercept of the horizontal line (21) with the vertical axis, $a_0=1$ and $a_{2k}$ are constants for $1 \leqq k \leqq n$ at least one of which is unequal to zero.

2. A color display tube (1) as claimed in claim 1, characterized in that $y=y_0.(1+a_2.x^2+a_4.x^4+a_6.x^6)$ and at least $a_4$ or $a_6$ is unequal to zero.

3. A color display tube (1) as claimed in claim 2, characterized in that $2.a_2+4.a_4.x_{max}^2+6.a_6.x_{max}^4 \leqq 0$, wherein $x_{max}$ is the maximum horizontal coordinate on the horizontal line (21).

4. A color display tube (1) as claimed in claim 2, characterized in that $y=y_0.(1+a_4.x^4)$.

5. A color display tube (1) as claimed in claim 2, characterized in that $y=y_0.(1+a_6.x^6)$.

6. A shadow mask for use in the color display tube of claim 1.

* * * * *